US010148028B1

(12) United States Patent
Yamamoto

(10) Patent No.: US 10,148,028 B1
(45) Date of Patent: Dec. 4, 2018

(54) TERMINAL FOR ROUND PIN-SHAPED ELECTRICAL CONTACT

(71) Applicant: YAZAKI CORPORATION, Tokyo (JP)

(72) Inventor: Hirotaka Yamamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/970,818

(22) Filed: May 3, 2018

(30) Foreign Application Priority Data

May 17, 2017 (JP) ..... 2017-097862

(51) Int. Cl.

| | |
|---|---|
| ***H01R 13/187*** | (2006.01) |
| ***H01R 4/18*** | (2006.01) |
| ***H01R 13/05*** | (2006.01) |
| *H01R 13/42* | (2006.01) |
| *H01R 13/11* | (2006.01) |

(52) U.S. Cl.
CPC ..... *H01R 13/187* (2013.01); *H01R 4/185* (2013.01); *H01R 13/052* (2013.01); *H01R 13/111* (2013.01); *H01R 13/42* (2013.01)

(58) Field of Classification Search
CPC ..... H01R 13/187; H01R 13/193; H01R 4/34; H01R 13/635; H01R 13/20
USPC ..... 439/843, 262, 217, 258, 177, 844
See application file for complete search history.

(56) References Cited

U.S. PATENT DOCUMENTS

| | | | | |
|---|---|---|---|---|
| 8,784,143 | B2 * | 7/2014 | Edgell | A61N 1/3752 439/246 |
| 8,808,039 | B2 * | 8/2014 | Mott | H01R 13/6275 439/843 |
| 8,851,940 | B2 * | 10/2014 | Friedhof | H01R 13/111 439/843 |
| 8,876,562 | B2 * | 11/2014 | Glick | H01R 13/187 439/843 |
| 8,990,070 | B2 * | 3/2015 | Dayan | G06F 8/37 704/252 |
| 9,011,186 | B2 * | 4/2015 | Wirth | H01R 13/112 439/843 |
| 2007/0123084 | A1 | 5/2007 | Takehara et al. | |

FOREIGN PATENT DOCUMENTS

JP 2007-173198 A 7/2007

* cited by examiner

*Primary Examiner* — Phuong Chi T Nguyen
(74) *Attorney, Agent, or Firm* — Kenealy Vaidya LLP

(57) ABSTRACT

A terminal includes a conductive terminal main body and a spring terminal. The terminal main body includes an electric wire crimping portion which caulks a crimping piece and an electrical contact portion which and accommodates the spring terminal to be electrically connected with the electrical contact. The electrical contact portion is formed with a slit for guiding the spring terminal in a cylindrical direction and a locking portion to lock the spring terminal to the slit. The spring terminal includes a resilient contact member provided with an opening divided in the cylindrical direction, the resilient contact member including knob portions formed to protrude outward from the opening at opening ends of the opening, the knob portion being locked to the locking portion, and an end to be inserted with the electrical contact of the resilient contact member is formed into a trumpet shape which expands in diameter outward.

3 Claims, 15 Drawing Sheets

TERMINAL FOR ROUND PIN-SHAPED ELECTRICAL CONTACT

CROSS REFERENCE TO RELATED APPLICATIONS

This application is based on Japanese Patent Application (No. 2017-097862) filed on May 17, 2017, the contents of which are incorporated herein by way of reference.

BACKGROUND

The present invention relates to a terminal for establishing an electrical connection with an electric wire mounted on one end of a terminal main body by inserting a round pin-shaped electrical contact at the other end of the terminal main body via a built-in spring terminal, specifically a terminal capable of reducing wear of the electrical contact due to the lateral displacement of the spring terminal and improving the workability when mounting the spring terminal to the terminal main body.

A plurality of electric devices are mounted on an automobile such as an electric vehicle or a hybrid car, and a plurality of electric wires for a large current are connected to these electric devices via connectors. This type of connector is formed by accommodating a round pin-shaped electrical contact and a terminal into which the electrical contact is inserted in a housing respectively. There is known a terminal including a cylindrical terminal main body into which an electrical contact is inserted and a cylindrical resilient contact member accommodated in the terminal main body and applying a contact pressure to the electrical contact.

In the related art, as described in JP-A-2007-173198, an electrical contact 1 for a connector to be inserted into a female terminal is formed in a substantially cylindrical shape in order to connect electric wires to each other as illustrated in FIGS. 1, 3, and 4. The connector electrical contact 1 is disposed inside a cylindrical female contact 11 and has an inner circumference inserted with a rod-shaped male contact 12, and a substantially cylindrical contact main body 2 is formed of a composite material of a conductive member 3 and a spring member 4.

The electrical contact 1 is used in a form in which the electrical contact 1 is sandwiched between the female contact 11 and the male contact 12. As described above, in the female terminal of the related art, the connector electrical contact 1 is disposed inside the cylindrical female contact 11. In the connector electrical contact 1, a plurality of elongated holes (slits) 6 having major axes perpendicular to a length direction are formed at predetermined intervals along the length direction of the composite material 5, and the composite material 5 is rounded along the length direction so that the spring member 4 becomes the inside and is formed into a substantially cylindrical shape as illustrated in FIG. 3 to form the contact main body 2. Then, the contact main body 2 having the substantially cylindrical shape is formed to have a diameter decreasing at the center portion and elasticity on the radially outward. Therefore, the male contact 12 is pressed by the spring force of the connector electrical contact 1.

SUMMARY

It is one advantageous aspect of the present invention to reduce the wear of an electrical contact due to the lateral displacement of a spring terminal and to improve the workability when mounting the spring terminal to a terminal main body.

According to one aspect of the invention, there is provide a terminal for a round pin-shaped electrical contact, including:

a conductive terminal main body including a cylindrical portion into which a round pin-shaped electrical contact is inserted; and a spring terminal configured to apply a contact pressure to the electrical contact to be inserted into the terminal main body, wherein the terminal main body includes an electric wire crimping portion which caulks a crimping piece to crimp an electric wire and an electrical contact portion which is formed in a cylindrical shape and accommodates the spring terminal to be electrically connected with the electrical contact, the electrical contact portion is formed with a slit for guiding the spring terminal in a cylindrical direction and a locking portion to lock the spring terminal to the slit, and the spring terminal is accommodated in the electrical contact portion and includes a resilient contact member provided with an opening divided in the cylindrical direction, the resilient contact member including knob portions formed to protrude outward from the opening at opening ends of the opening, the knob portion being locked to the locking portion, and an end to be inserted with the electrical contact of the resilient contact member is formed into a trumpet shape which expands in diameter outward.

The locking portion may be a recess which is formed in the slit to be wider than the width of the slit so as to accommodate the knob portion.

The locking portion may be formed by engaging protrusions each protruding to the slit as compared to the opening ends and engaging holes which are formed at places to abut to the slit of the knob portion and to which the engaging protrusions are fitted.

DETAILED DESCRIPTION OF EXEMPLIFIED EMBODIMENTS

In the female contact of the related art, since the connector electrical contact is formed of a spring, the rotation of the spring contact is not regulated, the connector electrical contact rotates after the male terminal and the female terminal are mated, and the connector electrical contact causes a problem of occurrence of wear in the male terminal.

Figure 3:
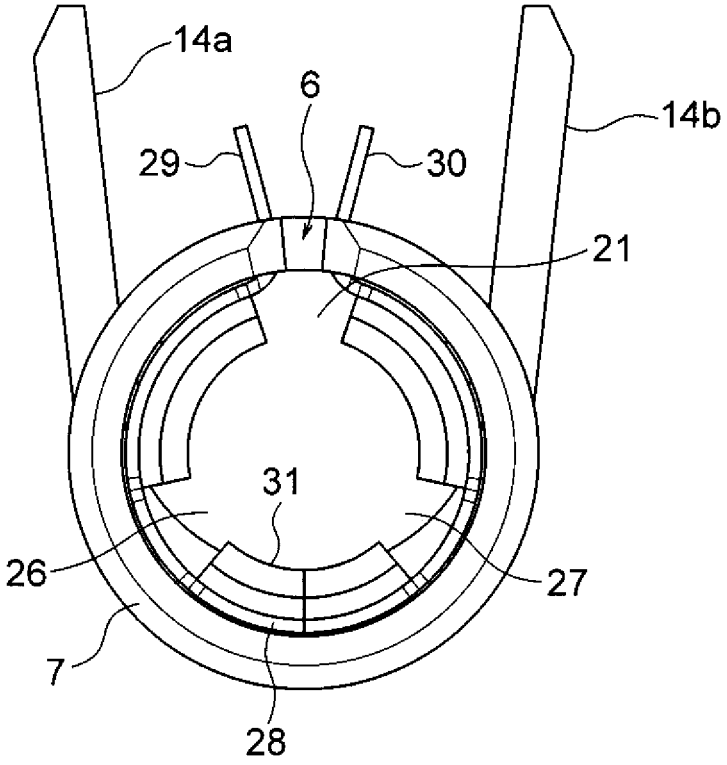
FIG. 3 is a front view illustrating the terminal illustrated in FIG. 1.

In order to accommodate the connector electrical contact in the female terminal, in the female contact of the related art, the composite material 5 is rounded along the length direction so that the spring member 4 becomes the inside and is formed in the substantially cylindrical shape as illustrated in FIG. 3 to form the contact body 2. Therefore, there is a problem that the work of disposing the female terminal inside the female contact 11 is not performed smoothly due to the spring force of the connector electrical contact, and the workability is not good.

The present invention is made in consideration of the above-described circumstances, and an object thereof is to reduce the wear of an electrical contact due to the lateral displacement of a spring terminal and to improve the workability when mounting the spring terminal to a terminal main body.

Hereinafter, embodiments of the present invention will be described with reference to the accompanying drawings.

First Embodiment

FIGS. 1 to 12 illustrate a terminal according to a first embodiment of the invention.

Figure 1:
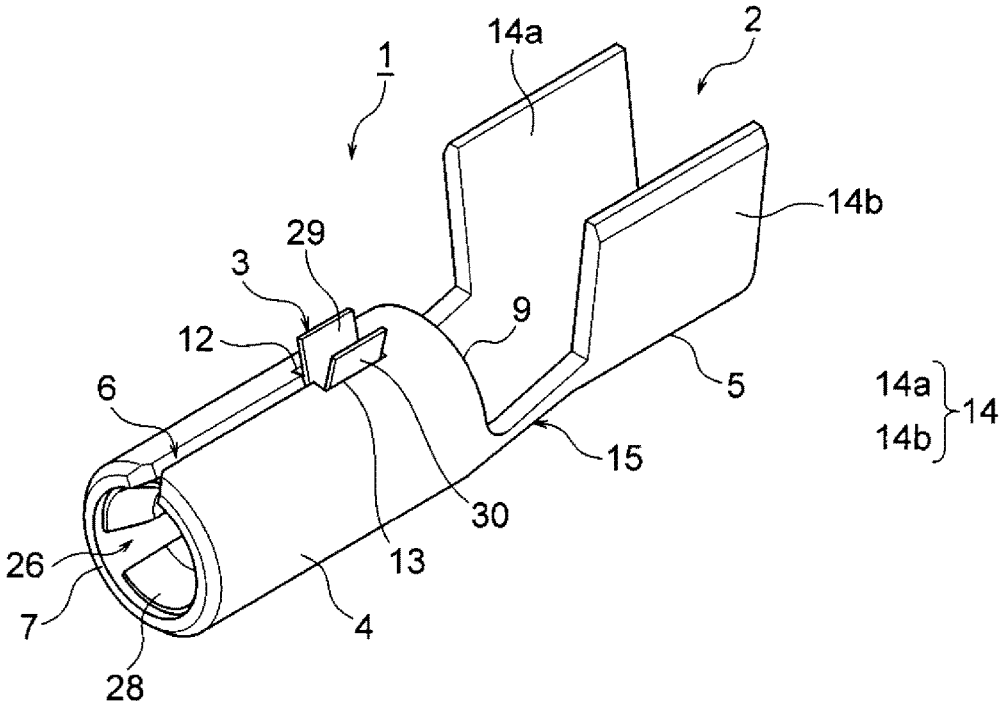
FIG. 1 is an overall perspective view illustrating a terminal according to a first embodiment in a state where a spring terminal is incorporated with an electrical contact portion.
Figure 2:
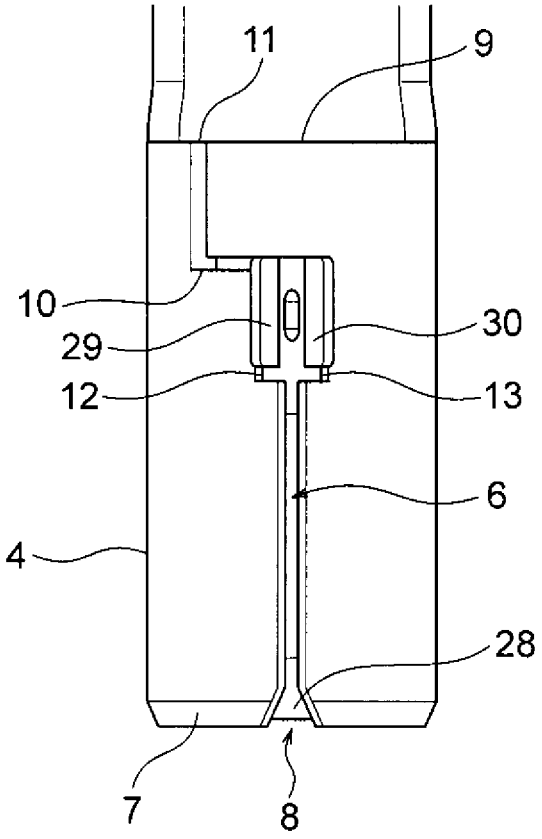
FIG. 2 is a plan view illustrating the terminal illustrated in FIG. 1.
Figure 4:
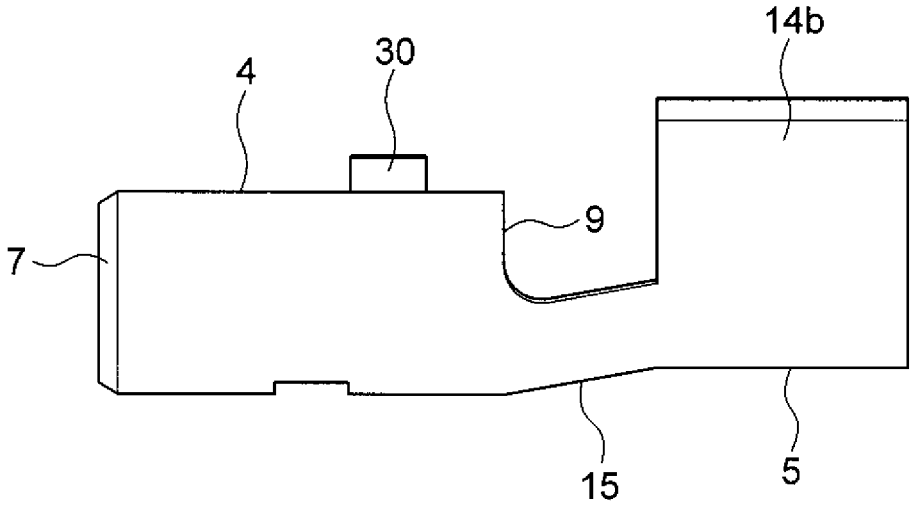
FIG. 4 is a side view illustrating the terminal illustrated in FIG. 1.
Figure 5:
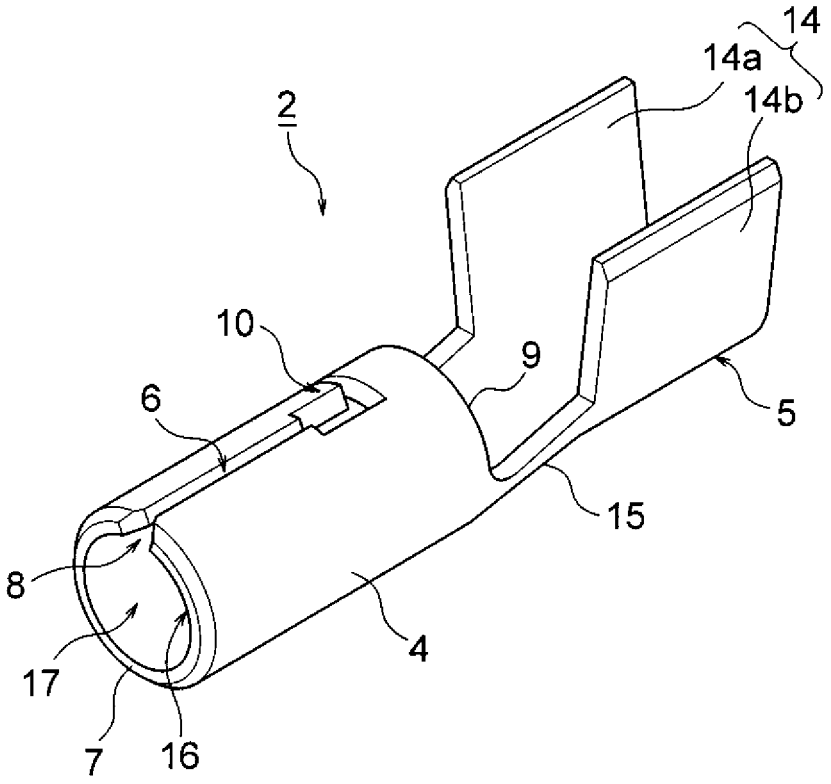
FIG. 5 is an overall perspective view illustrating a terminal main body of the terminal illustrated in FIG. 1.
Figure 6:
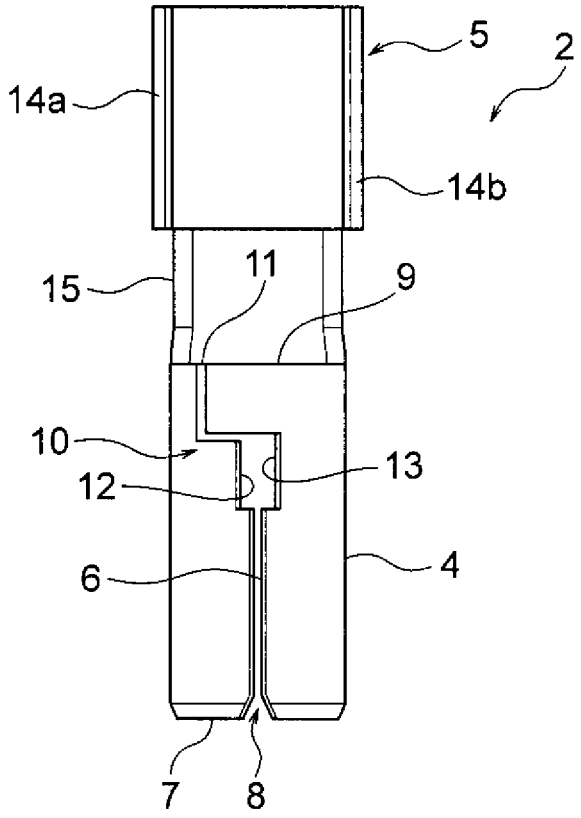
FIG. 6 is a plan view illustrating the terminal main body illustrated in FIG. 5.
Figure 7:
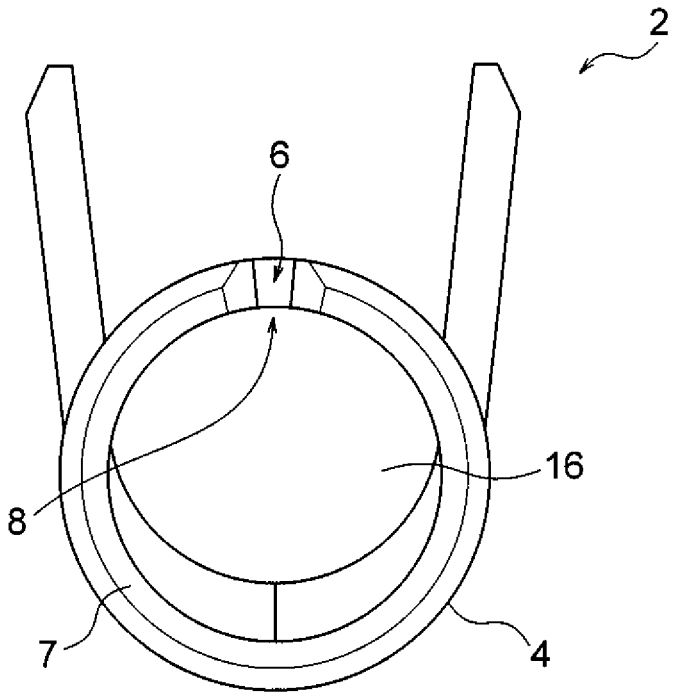
FIG. 7 is a front view illustrating the terminal main body illustrated in FIG. 5.
Figure 8:
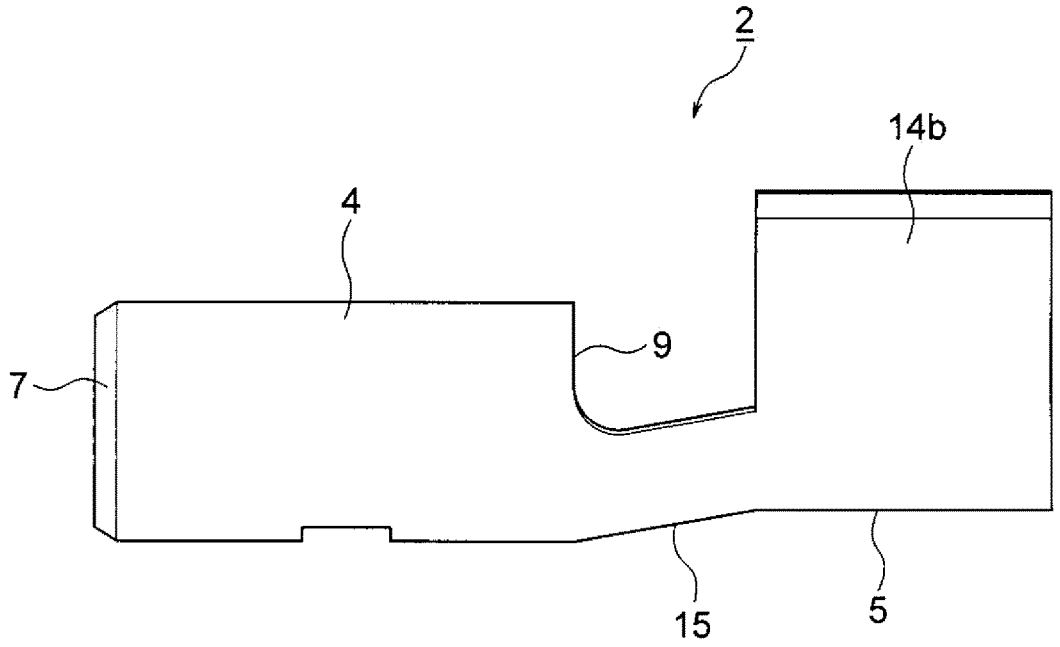
FIG. 8 is a side view illustrating the terminal main body illustrated in FIG. 5.
Figure 9:
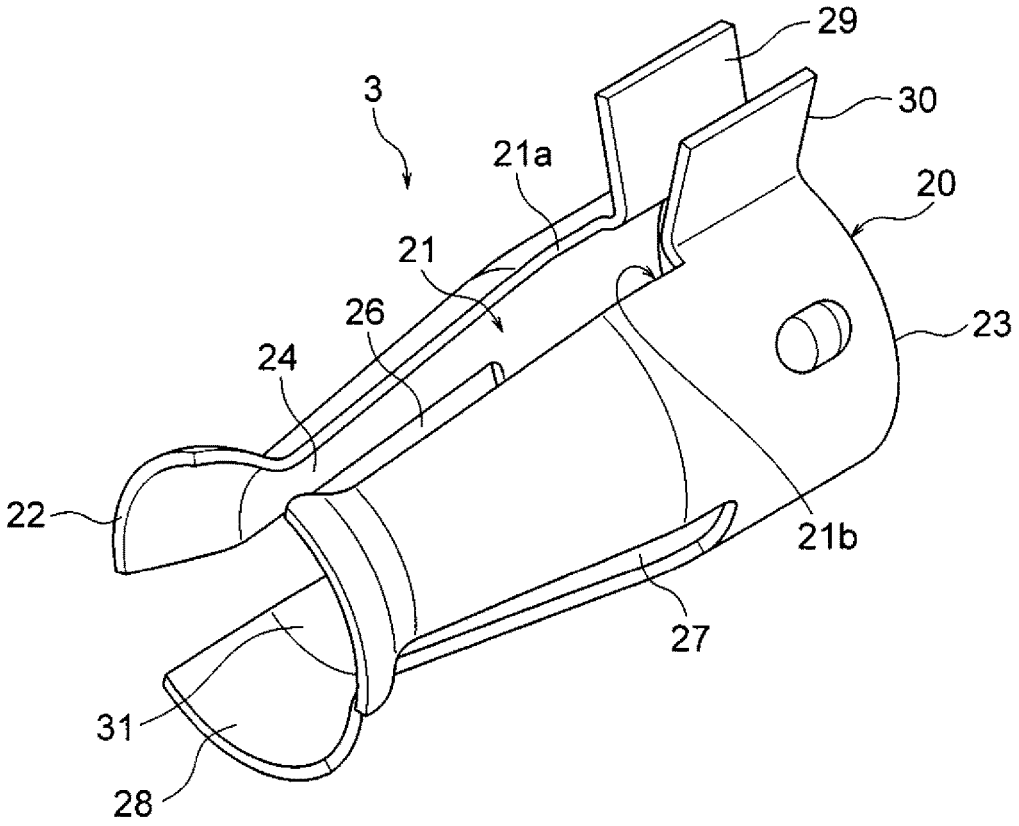
FIG. 9 is an overall perspective view illustrating the spring terminal illustrated in FIG. 1.
Figure 10:
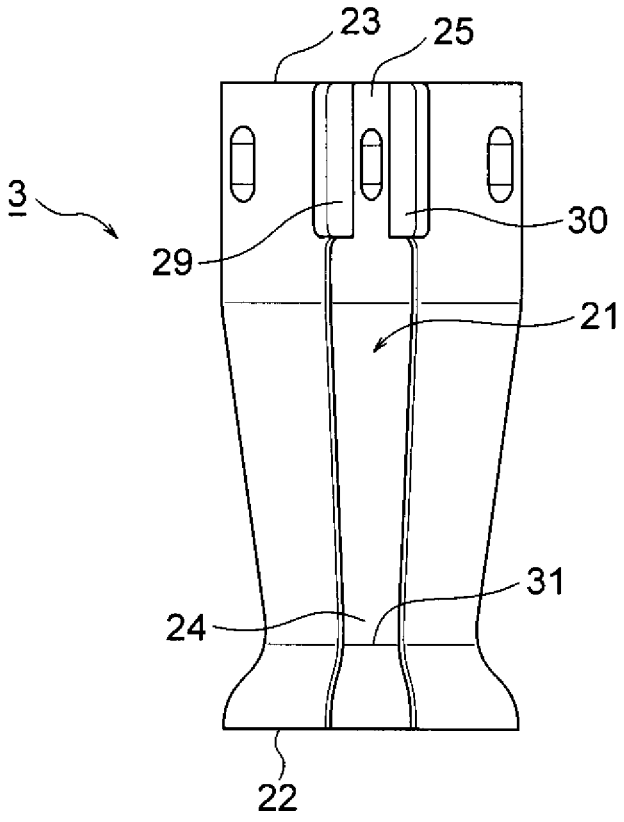
FIG. 10 is a plan view illustrating the spring terminal illustrated in FIG. 9.
Figure 11:
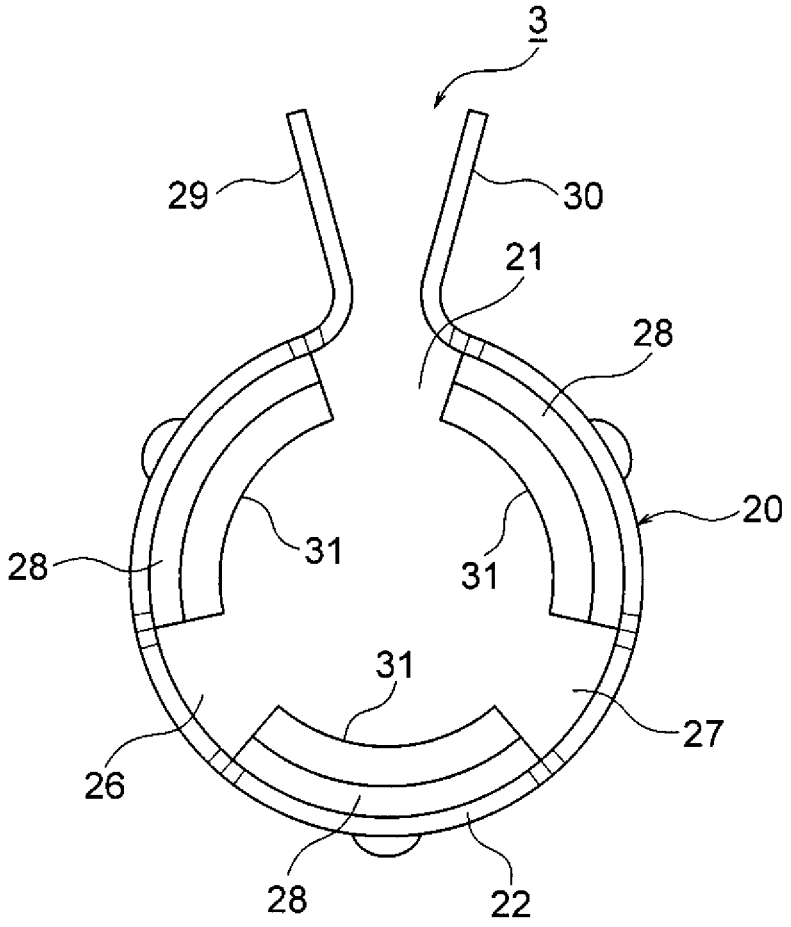
FIG. 11 is a front view illustrating the spring terminal illustrated in FIG. 9.
Figure 12:
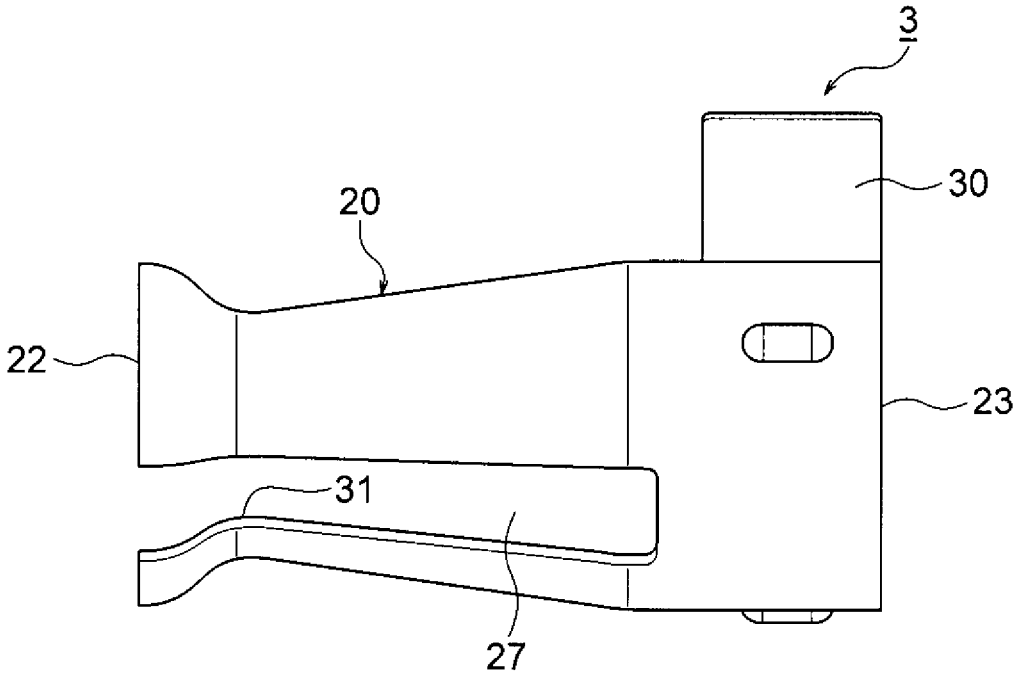
FIG. 12 is a side view illustrating the spring terminal illustrated in FIG. 9.

FIG. 1 is an overall perspective view illustrating the terminal according to the first embodiment in a state where a spring terminal is incorporated with an electrical contact portion, FIG. 2 is a plan view illustrating the terminal illustrated in FIG. 1, FIG. 3 is a front view illustrating the terminal illustrated in FIG. 1, FIG. 4 is a side view illustrating the terminal illustrated in FIG. 1, FIG. 5 is an overall perspective view illustrating a terminal main body of the terminal illustrated in FIG. 1, FIG. 6 is a plan view illustrating the terminal main body illustrated in FIG. 5, FIG. 7 is a front view illustrating the terminal main body illustrated in FIG. 5, FIG. 8 is a side view illustrating the terminal main body illustrated in FIG. 5, FIG. 9 is an overall perspective view illustrating the spring terminal illustrated in FIG. 1, FIG. 10 is a plan view illustrating the spring terminal illustrated in FIG. 9, FIG. 11 is a front view illustrating the spring terminal illustrated in FIG. 9, and FIG. 12 is a side view illustrating the spring terminal illustrated in FIG. 9.

In FIGS. 1 to 4, a terminal 1 according to the invention is wholly illustrated.

The terminal 1 according to the embodiment is used in a connector for connecting large electric current wires respectively connected to two electric devices mounted on an electric vehicle, a hybrid car, or the like. The terminal 1 is connected to a terminal of each electric wire and is held in a resin housing (not illustrated), for example.

In FIGS. 1 to 4, the terminal 1 includes a terminal main body 2 and a spring terminal 3.

As illustrated in FIGS. 5 to 8, the terminal main body 2 includes an electrical contact portion 4 formed in a cylindrical shape and an electric wire crimping portion 5 which is connected to the electrical contact portion 4 and crimps and connects an electric wire.

The electrical contact portion 4 is a portion to be inserted with the spring terminal 3, into which a mating-side round pin-shaped electrical contact (not illustrated) is inserted. On an upper portion of the electrical contact portion, a slit 6 is provided in the cylindrical direction as illustrated in FIG. 5. The slit 6 is formed with a front end opening 8, which is opened at a front end 7 on one end of the electrical contact portion 4.

The linear other end of the slit 6 is closed at a rear end 9 of the electrical contact portion 4. As illustrated in FIG. 6, the slit 6 is formed with a bent portion 10 that is bent at right angles to the cylindrical direction and further bent in the cylindrical direction in the vicinity of the rear end 9 of the electrical contact portion 4, thereby forming in a crank shape. A front end of the bent portion 10 bent in the cylindrical direction serves as a rear end opening 11, which is opened at the rear end 9 of the electrical contact portion 4.

In the vicinity of abutting against the rear end 9 of the linear electrical contact portion 4 of the slit 6, both ends forming the slit 6 are formed with recesses 12 and 13, which are cut out in a rectangular shape so as to be wider than the width of the slit 6, respectively. These recesses 12 and 13 cut out in the rectangular shape form a locking portion for locking the spring terminal 3.

The electric wire crimping portion 5 crimps and fixes an electric wire (not illustrated) and includes conductor caulking pieces 14 for crimping a conductor of the electric wire (not illustrated).

In specific, the electric wire crimping portion 5 includes a pair of conductor caulking pieces 14*a* and 14*b* formed so that the wings spread upward, and is formed such that the conductor of the electric wire is interposed between the pair of conductor caulking pieces 14*a* and 14*b* to be caulked and crimped by the pair of conductor caulking pieces 14*a* and 14*b*.

The electrical contact portion 4 and the electric wire crimping portion 5 of the terminal main body 2 are coupled to each other by a coupling portion 15. The inner portion of the electrical contact portion 4 of the terminal main body 2 serves as an accommodating portion 16 of the spring terminal 3. In addition, the front end of the electrical contact portion on the opposite side to the conductor caulking piece 14 serves as an insertion port 17 into and from which the round pin terminal of the male terminal is inserted and removed.

The terminal main body 2 is formed with, in order from the front, the cylindrical electrical contact portion 4, the coupling portion 15, and the electric wire crimping portion 5. The electrical contact portion 4 is formed to have a slightly narrower inner diameter than the maximum outer diameter of the spring terminal 3 having a cylindrical shape.

In the coupling portion 15, a conductor exposed from the end of the electric wire is connected by crimping, welding or the like. The electric wire crimping portion 5 is bent to wrap around the insulating sheath of the terminal of the electric wire so as to crimp and fix the electric wire to the terminal main body 2.

The connecting portion 15 is set to have a width dimension smaller than the width dimension of the electrical contact portion 4 and is formed to extend in a tapered shape in an axial direction. The wire crimping portion 5 is set to have a width dimension larger than the width dimension of the electrical contact portion 4.

The spring terminal 3 has a structure as illustrated in FIGS. 9 to 12, is accommodated in the electrical contact portion 4 of the terminal main body 2, and includes a resilient contact member 20 formed in a cylindrical shape. To the resilient contact member 20, a mating-side round pin-shaped electrical contact (not illustrated) is to be inserted.

As illustrated in FIGS. 10 and 11, the resilient contact member 20 is provided with a cut part 21 which is divided into two in the cylindrical direction at the upper portion, and a slit in the cylindrical direction is formed. A front end 22 of the resilient contact member 20, and a front end opening 24 and a rear end opening 25 which open at both ends of the rear end 23 are formed in the cut part 21.

A plurality of (two in this embodiment) slits 26 and 27 are formed in the resilient contact member 20 in the cylindrical direction.

The cylindrical portion of the resilient contact member 20 has a shape reduced in diameter from the rear end side toward the front end side and narrowed down. The front end of the resilient contact member 20 which is an insertion side end of the electrical contact is formed with a larger diameter portion 28 which expands outward in a trumpet shape from a minimum diameter portion 31 of the resilient contact member 20. The diameter of the larger diameter portion 28 is formed to be larger than the inner diameter of the electrical contact portion 4 of the terminal main body 2.

In this manner, the inner surface of the cylindrical portion of the resilient contact member 20 expands in diameter toward the front end of the resilient contact member 20 at the minimum diameter portion and becomes the maximum expanded portion at the front end.

Accordingly, the inner surface of the cylindrical portion of the resilient contact member 20 is formed with a local surface at the minimum diameter portion, and the mating-side round pin-shaped electrical contact to be inserted into the resilient contact member 20 is sandwiched on this local surface. That is, the inner surface of the cylindrical portion of the resilient contact member 20 has a rounded edge at the contact portion where the mating-side round pin-shaped electrical contact comes into contact, thereby preventing scraping the mating-side round pin-shaped electrical contact at the edge of the contact portion.

In this way, since the front end of the resilient contact member 20 is formed in a trumpet shape to have a larger diameter and formed to have a diameter larger than the inner diameter of the electrical contact portion 4 of the terminal main body 2, when the front end of the resilient contact member is accommodated in the contact portion 4 of the terminal main body 2, it is pressed by the inner surface of the electrical contact portion 4 of the terminal main body 2 to press the inner surface of the cylindrical portion of the resilient contact member 20 in the direction of the center axis, thereby generating a spring force. The spring contact at this time is divided into three pieces by the cut part 21 at the upper portion of the cylindrical portion of the resilient contact member 20 and the two slits 26 and 27 in the cylindrical direction, so that it is three points.

That is, the mating-side round pin-shaped electrical contact inserted into the resilient contact member 20 is pressed at three points in the inner surface of the cylindrical portion of the resilient contact member 20 in the direction of the center axis at the minimum diameter part of the resilient contact member 20.

Rear opening ends 21*a* and 21*b* of the opening end of the opening formed by the cut part 21 provided in the cylindrical direction of the cylindrical portion of the resilient contact member 20 are provided with knob portions 29 and 30 protruding in a feather-like shape to the outside from the opening, respectively. When the resilient contact member 20 is inserted into the electrical contact portion 4 of the terminal main body 2, the knob portions 29 and 30 are pinched with fingertips to close the cut part 21 at the upper portion of the cylindrical portion of the resilient contact member 20, so that the diameter of the cylindrical portion of the resilient contact member 20 is reduced and thus the resilient contact member 20 is inserted into the electrical contact portion 4 of the terminal main body 2.

When the resilient contact member 20 is mounted to the electrical contact portion 4 of the terminal main body 2, the knob portions 29 and 30 are pinched with fingertips to guide the resilient contact member 20 to the deep inside of the slit 6 of the electrical contact portion 4. The knob portions 29 and 30 are formed such that when being guided to the deep inside of the slit 6 of the electrical contact portion 4, the knob portions are fitted in the recesses 12 and 13 cut out in a rectangular shape at both ends of the slit 6, respectively.

By fitting the knob portions 29 and 30 into the recesses 12 and 13, the resilient contact member 20 mounted to the electrical contact portion 4 can be prevented from rotating within the electrical contact portion 4 or coming off in the cylindrical direction from the electrical contact portion 4. Therefore, the width of the knob portions 29 and 30 in the cylindrical direction is formed to be smaller than the opening width of the recesses 12 and 13.

The knob portions 29 and 30 together with the recesses 12 and 13 formed in the slit 6 of the electrical contact portion 4 form a locking portion for locking the spring terminal 3.

The spring terminal 3 configured as described above is formed in such a manner that the knob portions 29 and 30 of the resilient contact member 20 are pinched so that the diameter of the resilient contact member 20 is made smaller than the inner diameter of the electrical contact portion 4 and the resilient contact member 20 is fitted into the slit 6. At this time, since the resilient contact member 20 is divided into three pieces by the cut part 21 at the upper portion of the cylindrical portion and the two slits 26 and 27 in the cylindrical direction, the three pieces are inserted while being in contact with the inner surface of the electrical contact portion 4.

When the front end of the resilient contact member 20 is mounted to the electrical contact portion 4, since the front end of the resilient contact member 20 is formed into a trumpet shape to have a diameter larger than the inner diameter of the electrical contact portion 4 of the terminal main body 2, the front end of the resilient contact member 20 is caulked inward by the electrical contact portion 4.

Therefore, when the front end of the resilient contact member 20 is accommodated in the electrical contact portion 4 of the terminal main body 2, the front end of the resilient contact member 20 having a large diameter is pressed by the inner surface of the electrical contact portion 4 of the terminal main body 2 at the inner surface of the cylindrical portion in the direction of the central axis. Similarly, the minimum diameter portion of the resilient contact member 20 is pressed at the inner surface of the cylindrical portion in the direction of the central axis. At this time, if the mating-side round pin-shaped electrical contact is inserted into the resilient contact member 20, a spring force is generated to press the electrical contact in the central axis direction.

Even if the mating-side round pin-shaped electrical contact is pressed by the spring force at the minimum diameter portion of the resilient contact member 20, since the inner surface of the minimum diameter portion of the resilient contact member 20 is formed with a rounded edge, it is prevented that the mating-side round pin-shaped electric contact is scraped.

That is, the inner surface of the minimum diameter portion of the resilient contact member 20 is formed with a rounded edge, and the knob portions 29 and 30 are fitted into the recesses 12 and 13, the resilient contact member 20 mounted to the electrical contact portion 4 is prevented from rotating in the electrical contact portion 4 or coming off in the cylindrical direction from the electrical contact portion 4, so that it is possible to reduce the wear amount of the mating-side round pin-shaped electrical contact.

Since the spring terminal 3 does not rotate in the electrical contact portion 4 with the structure of preventing the rotation and coming-off, the wear amount of the mating-side round pin-shaped electrical contact is decreased and the resistance value is stabilized.

Next, the operation of the resilient contact member 20 when the resilient contact member 20 is inserted into the electrical contact portion 4 of the terminal main body 2 will be described.

First, the knob portions 29 and 30 of the resilient contact member 20 are pinched with fingertips, the cut part 21 at the upper portion of the cylinder portion of the resilient contact member 20 is closed, and the outer diameter of the resilient contact member 20 becomes narrower than the inner diameter of the electrical contact portion 4 of the terminal main body 2. Thereafter, the resilient contact member 20 is inserted into the electrical contact portion 4 of the terminal main body 2 by inserting the knob portions 29 and 30 into the slit 6 from the side of the front end opening 8 of the electrical contact portion 4.

At this time, since the diameter of the resilient contact member 20 is smaller than the inner diameter of the electrical contact portion 4, the insertion is smoothly performed, and it is possible to guide the resilient contact member 20 to the deep inside of the slit 6 by pinching the knob portions 29 and 30.

When the knob portions 29 and 30 of the resilient contact member 20 are pinched with fingertips to be inserted into the slit 6 of the electrical contact portion 4 of the terminal main body 2 from the side of the front end opening 8 until reaching the deep inside of the electrical contact portion 4, the knob portions 29 and 30 are respectively fitted and locked to the recesses 12 and 13 cut out in a rectangular shape at the opposite ends of the slit 6.

According to the embodiment having the above-described configuration, the slit 6 is formed in the electrical contact portion 4 of the terminal main body 2, the knob portions 29 and 30 are formed in the resilient contact member 20 of the spring terminal 3, and the knob portions 29 and 30 are inserted into the slit 6. Accordingly, the workability at the time of assembly of the resilient contact member 20 of the spring terminal 3 to the electrical contact portion 4 of the terminal main body 2.

Second Embodiment

Figure 13:
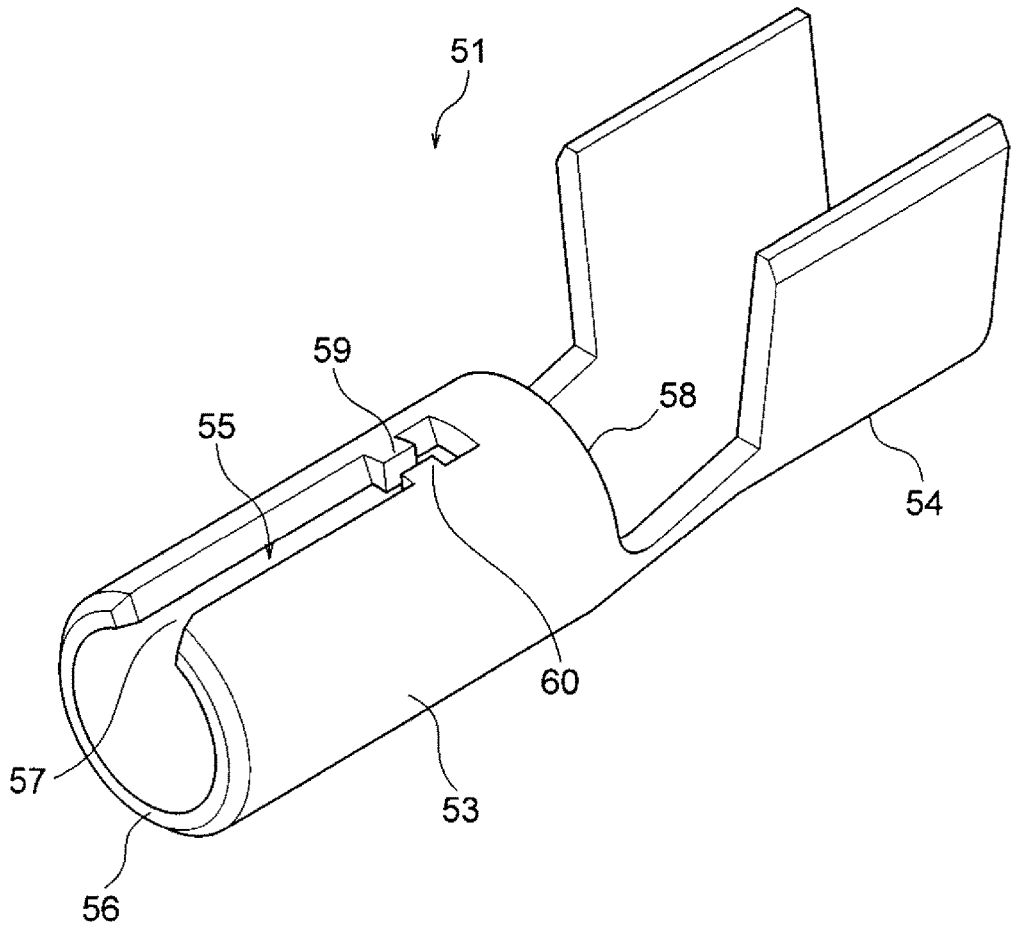
FIG. 13 is an overall perspective view illustrating a terminal main body.
Figure 14:
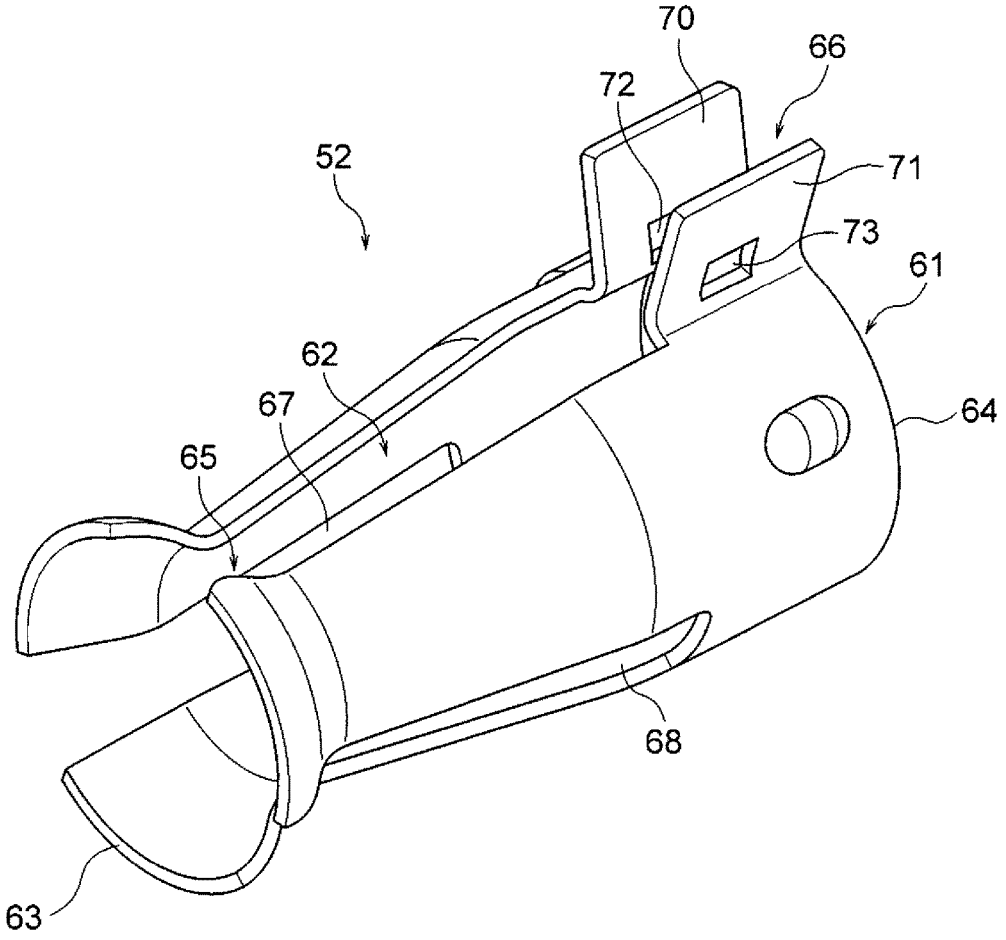
FIG. 14 is an overall perspective view illustrating a spring terminal.
Figure 15:
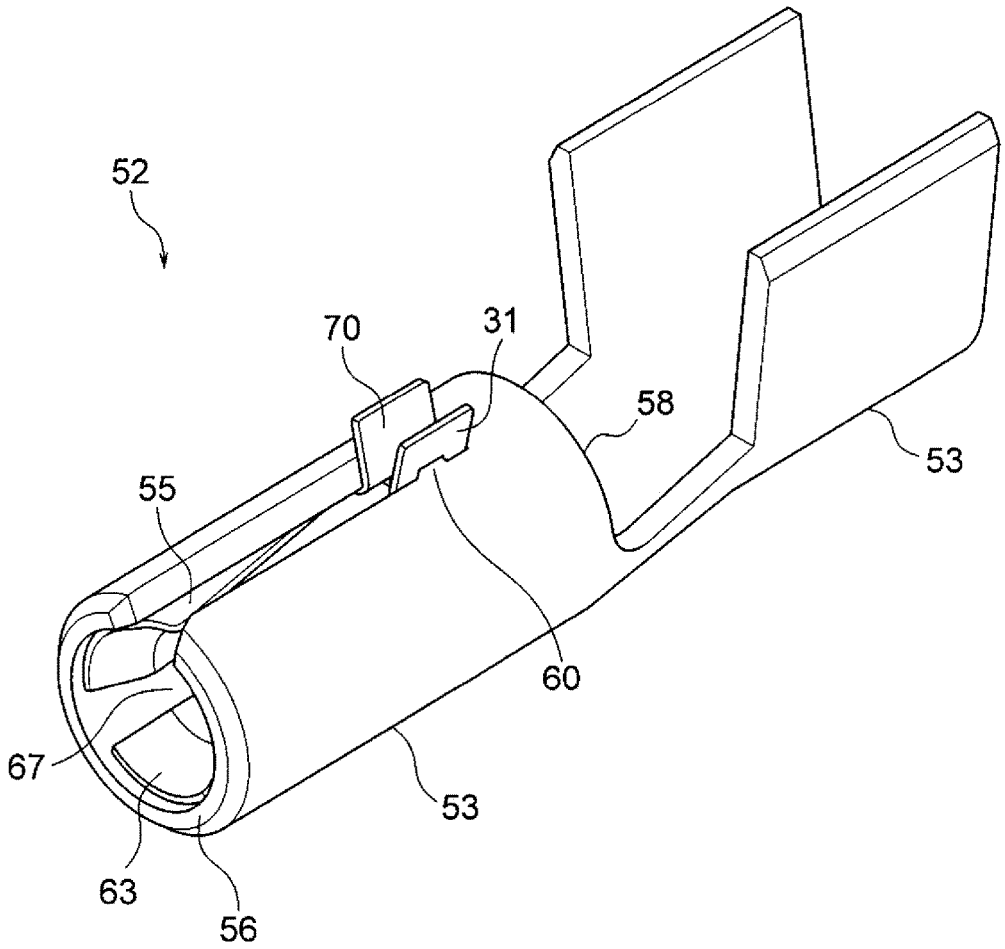
FIG. 15 is an overall perspective view illustrating a terminal according to a second embodiment in a state where the spring terminal is incorporated with an electrical contact portion.

FIGS. 13 to 15 illustrate a terminal 50 according to a second embodiment of the invention.

FIG. 13 is an overall perspective view illustrating a terminal main body of the terminal according to the second embodiment of the invention, FIG. 14 is an overall perspective view illustrating a spring terminal of the terminal according to the second embodiment of the invention, and FIG. 15 is an overall perspective view illustrating the terminal according to the second embodiment in a state where the spring terminal is incorporated with an electrical contact portion.

In FIGS. 13 to 15, the terminal 50 according to the second embodiment of the invention is illustrated, and the terminal 50 includes a terminal main body 51 and a spring terminal 52.

As illustrated in FIG. 13, the terminal main body 51 includes an electrical contact portion 53 formed in a cylindrical shape and an electric wire crimping portion 54 connected to the electrical contact portion 53 and crimping and connecting the electric wire.

Since the terminal main body 51 illustrated in FIG. 13 has the same structure as the terminal main body 2 illustrated in FIGS. 5 to 8, only differences from the terminal main body 2 illustrated in FIGS. 5 to 8 will be described.

The electrical contact portion 53 illustrated in FIG. 13 is different from the electrical contact portion 4 illustrated in FIGS. 9 to 12 in that both ends forming the slit 6 in the vicinity of abutting against the rear end 9 of the air contact portion 4 illustrated in FIGS. 5 to 8 are formed with the recesses 12 and 13 which are notched in a rectangular shape so as to be wider than the width of the slit 6, respectively, whereas the electrical contact portion 53 illustrated in FIG. 13 has an alternative structure. Other points are the same as the configuration of the electrical contact portion 4 illustrated in FIGS. 9 to 12.

That is, a spring terminal 52 inserted with a mating-side round pin-shaped electrical contact (not illustrated) is inserted into the electrical contact portion 53, and as illustrated in FIG. 13, a slit 55 is provided in the cylindrical direction in the upper portion of the electrical contact portion 53. The slit 55 is formed with a front end opening 57 that opens at the front end 56 of the electrical contact portion 53 on one end side In the vicinities of the slit 55 to abut against the rear end 58 of the linear electrical contact portion 53, protrusions 59 and 60 which are formed in a rectangular shape and protrude inward from the both ends of the slit 55 are formed at both ends forming the slit 55, respectively. The protrusions 59 and 60, which are formed in a rectangular shape and protrude, form a locking portion for locking the spring terminal 52.

As illustrated in FIG. 14, the spring terminal 52 is accommodated in the electrical contact portion 53 of the terminal main body 51 and includes a resilient contact member 61 formed in a cylindrical shape. To the resilient contact member 61, a mating-side round pin-shaped electrical contact (not illustrated) is inserted.

As illustrated in FIG. 14, the resilient contact member 61 is provided with a cut part 62 which is divided into two in the cylindrical direction at the upper portion. In the cut part 62, a front end 63 of the resilient contact member 61, and a front end opening 65 and a rear end opening 66 which are opened at both ends of the rear end 64 are formed.

A plurality of (two in the embodiment) slits 67 and 68 are formed in the cylindrical direction in the resilient contact member 61.

At rear opening ends 69*a* and 69*b* of the opening end of the opening formed by the cut part 62 provided in the cylindrical direction of the cylindrical portion of the resilient contact member 61, knob portions 70 and 71 are formed to protrude in a feather-like shape to the outside from the opening, respectively.

When inserting the resilient contact member 61 into the electrical contact portion 53 of the terminal main body 51, the knob portions 70 and 71 are pinched with fingertips to close the cut part 62 at the upper portion of the cylindrical portion of the resilient contact member 61. Therefore, the diameter of the cylindrical portion of the resilient contact member 61 is reduced and thus the resilient contact member 61 is inserted into the electrical contact portion 53 of the terminal main body 51.

The resilient contact member 61 illustrated in FIG. 14 is different from the resilient contact member 20 illustrated in FIGS. 9 to 12 in that nothing is formed on the knob portions 29 and 30 of the resilient contact member 20 illustrated in FIGS. 9 to 12, whereas, in the portions of the knob portions 70 and 71 of the resilient contact member 61 illustrated in FIG. 14 which abut to the slit formed by the cut part 62, engaging holes 72 and 73 are formed which are inserted with the protrusions 59 and 60 having a rectangular shape and protruding toward the inside of the slit 55 of the terminal main body 51 from the both ends of the slit. Other points are the same as the configuration of the resilient contact member 20 illustrated in FIGS. 9 to 12.

FIG. 15 illustrates a state in which the resilient contact member 61 of the spring terminal 52 illustrated in FIG. 14 is incorporated in the electrical contact portion 53 of the terminal main body 51 illustrated in FIG. 13 configured as described above.

First, the knob portions 70 and 71 of the resilient contact member 61 are pinched with fingertips to close the cut part 62 at the upper portion of the cylindrical portion of the resilient contact member 61, and the outer diameter of the resilient contact member 61 is made to be smaller than the inner diameter of the electrical contact portion 53 of the terminal main body 51. Thereafter, the knob portions 70 and 71 of the resilient contact member 61 are inserted into the slit 55 of the electrical contact portion 53 of the terminal main body 51 from the side of the front end opening 57 of the electrical contact portion 53.

At this time, since the diameter of the resilient contact member 61 is smaller than the inner diameter of the electrical contact portion 53, the resilient contact member 61 is smoothly inserted and can be guided until reaching the deep inside of the slit 55 while the knob portions 70 and 71 of the resilient contact member 61 are pinched.

When the knob portions 70 and 71 of the resilient contact member 61 are pinched by fingertips and inserted into the slit 55 of the electrical contact portion 53 of the terminal main body 51 from the side of the front end opening 57 to be guided until reaching the deep inside of the electrical contact portion 53, the knob portions 70 and 71 are locked by being fitted with protrusions 59 and 60 having a rectangular shape and protruding inward from the both ends of the slit 55 of the terminal main body 51 formed in the resilient contact member 61 at the places abutting to the slit formed by the cut part 62 of the both ends of the slit 55.

The present invention may be variously modified without changing the gist of the invention.

Herein, the features of the embodiments of the connector according to the invention will be simply summarized in the following [1] to [3].

[1] A terminal (1, 50) for a round pin-shaped electrical contact, including:

a conductive terminal main body (2, 51) including a cylindrical portion into which a round pin-shaped electrical contact is inserted; and a spring terminal (3, 52) configured to apply a contact pressure to the electrical contact to be inserted into the terminal main body (2, 51), wherein the terminal main body (2, 51) includes an electric wire crimping portion (5, 54) which caulks a crimping piece to crimp an electric wire and an electrical contact portion (4, 53) which is formed in a cylindrical shape and accommodates the spring terminal (3, 52) to be electrically connected with the electrical contact, the electrical contact portion (4, 53) is formed with a slit (6, 55) for guiding the spring terminal (3, 52) in a cylindrical direction and a locking portion to lock the spring terminal (3, 52) to the slit (6, 55), and the spring terminal (3, 52) is accommodated in the electrical contact portion (4) and includes a resilient contact member (20, 61) provided with an opening (8, 57) divided in the cylindrical direction, the resilient contact member (20, 61) including knob portions (29, 30, 70, 71) formed to protrude outward from the opening (8, 57) at opening ends of the opening (8, 57), the knob portion (29, 30, 70, 71) being locked to the locking portion, and an end to be inserted with the electrical contact of the resilient contact member (20, 61) is formed into a trumpet shape which expands in diameter outward.

[2] The terminal according to [1], wherein the locking portion is a recess (12, 13) which is formed in the slit (6) to be wider than the width of the slit (6) so as to accommodate the knob portion (29, 30).

[3] The terminal according to [1], wherein the locking portion is formed by engaging protrusions (59, 60) each protruding to the slit (55) as compared to the opening ends (69*a*, 69*b*) and engaging holes (72, 73) which are formed at places to abut to the slit (55) of the knob portion (70, 71) and to which the engaging protrusions (59, 60) are fitted.

According to the invention having such characteristics, since the knob portions of the spring terminal are locked to the locking portions of the slit of the terminal main body, it is possible to prevent the lateral displacement of the spring terminal and to reduce the wear amount of the round pin-shaped electrical contact (male terminal).

In addition, according to the invention having such characteristics, since the knob portions of the spring terminal are locked to the locking portions of the slit of the terminal main body, it is possible to prevent the spring terminal from rotating or coming off.

Further, according to the invention having such characteristics, in accommodating the spring terminal in the electrical contact portion, the knob portions of the spring terminal are pinched so that the cylinder diameter of the spring terminal can be made smaller than the cylinder diameter of the electrical contact portion and the workability of inserting the spring terminal can be improved. Therefore, it is possible to improve the productivity of the terminal.

According to the invention having such characteristics, the locking portion is formed as the recesses which are formed in the slit, accommodate the knob portions, and have a wider width than the slit. Therefore, when accommodating the spring terminal in the electrical contact portion, it is possible to easily lock the spring terminal to the electrical contact portion by simply moving the spring terminal in the state where the knob portions are pinched until reaching the end of the slit of the electrical contact portion.

According to the invention having such characteristics, since the locking portion is formed by the engaging protrusions protruding to the slit as compared to the opening ends and engaging holes which are formed at places to abut to the slit of the knob portions and to which the protrusions are fitted, when accommodating the spring terminal in the electrical contact portion, it is possible to easily lock the spring terminal to the electrical contact portion by simply moving the spring terminal in the state where the knob portions are pinched until reaching the end of the slit of the electrical contact portion.

According to the invention, it is possible to reduce the wear of the electrical contact due to the lateral displacement of the spring terminal and to improve the workability when mounting the spring terminal to the terminal main body.

What is claimed is:

1. A terminal for a round pin-shaped electrical contact, comprising:

a conductive terminal main body including a cylindrical portion into which a round pin-shaped electrical contact is inserted; and a spring terminal configured to apply a contact pressure to the electrical contact to be inserted into the terminal main body, wherein the terminal main body includes an electric wire crimping portion which caulks a crimping piece to crimp an electric wire and an electrical contact portion which is formed in a cylindrical shape and accommodates the spring terminal to be electrically connected with the electrical contact, the electrical contact portion is formed with a slit for guiding the spring terminal in a cylindrical direction and a locking portion to lock the spring terminal to the slit, and the spring terminal is accommodated in the electrical contact portion and includes a resilient contact member provided with an opening divided in the cylindrical direction, the resilient contact member including knob portions formed to protrude outward from the opening at opening ends of the opening, the knob portion being locked to the locking portion, and an end to be inserted with the electrical contact of the resilient contact member is formed into a trumpet shape which expands in diameter outward.

2. The terminal according to claim 1, wherein the locking portion is a recess which is formed in the slit to be wider than the width of the slit so as to accommodate the knob portion.

3. The terminal according to claim 1, wherein the locking portion is formed by engaging protrusions each protruding to the slit as compared to the opening ends and engaging holes which are formed at places to abut to the slit of the knob portion and to which the engaging protrusions are fitted.

* * * * *